US006962641B2

(12) United States Patent
Chocklett et al.

(10) Patent No.: US 6,962,641 B2
(45) Date of Patent: Nov. 8, 2005

(54) ARTS AND CRAFTS MATERIAL

(76) Inventors: Blane L. Chocklett, P.O. Box 7483, Roanoke, VA (US) 24019; Harrison R. Steeves, P.O. Box 7483, Roanoke, VA (US) 24019

( * ) Notice: Subject to any disclaimer, the term of this patent is extended or adjusted under 35 U.S.C. 154(b) by 0 days.

(21) Appl. No.: 09/973,602

(22) Filed: Oct. 9, 2001

(65) Prior Publication Data

US 2003/0068474 A1 Apr. 10, 2003

(51) Int. Cl.[7] ..... B44G 1/24

(52) U.S. Cl. ..... 156/233; 43/42.25; 43/42.27; 43/42.28; 43/42.33; 43/42.37; 43/42.41; 156/235; 156/256; 428/40.9; 428/41.1; 428/41.2; 428/42.2; 428/42.3

(58) Field of Search ..... 428/40.9, 41.1, 428/41.2, 42.2, 42.3, 195.1, 209, 304.5, 195; 43/42.25, 42.27, 42.28, 42.33, 42.41, 42.37; 156/235, 233, 256

(56) References Cited

U.S. PATENT DOCUMENTS 4,037,346 A * 7/1977 Holst ..... 43/42.14
4,225,641 A * 9/1980 Yokomizo ..... 428/41
4,307,531 A * 12/1981 Honse ..... 43/42.32

* cited by examiner

*Primary Examiner*—Bruce Hess
(74) *Attorney, Agent, or Firm*—Troutman Sanders LLP; James Hunt Yancey, Jr.

(57) ABSTRACT

An arts and crafts material having a foil pattern imprinted thereon. In one embodiment, the arts and crafts material of the present invention includes a sheet of foil substantially uniformly adhered to a corresponding sheet of base material such as foam. Once the foil sheet is secured to the base material, the foil sheet is peeled back to disclose the foil sheet's coating transferred onto the base material. The base material is preferably resiliently compressible. Portions of the sheet of arts and crafts material maybe cut to form particular shapes such as body and tail portions of fishing flies.

19 Claims, 2 Drawing Sheets

ARTS AND CRAFTS MATERIAL

TECHNICAL FIELD

The present invention relates to arts and crafts materials. This invention more particularly pertains to a material having a foil-based coating which may be used in a wide variety of applications.

BACKGROUND OF THE INVENTION

There is a myriad of arts and crafts materials available to today's hobbyists and small businesses. However, most of these known materials are suitable for only limited applications. One known type of material is construction paper. Although construction paper may be cut into any desired shape, it is not very durable or wetable. Also, construction paper may be used to cover a surface, but typically the paper does not adhere completely to the surface being covered. There are often gaps between the two materials which allow the two materials to separate over time. Moreover, construction paper may be easily torn.

In response to the realized inadequacies of known materials, a more versatile product is needed which can be manufactured in an economical manner. This new product must be capable of being manufactured without having portions of the product separating from one another even after the product has been cut to a particular shape or size. Moreover, this new product must be suitable for use in multiple environments such as water without being torn.

SUMMARY OF THE INVENTION

The present invention provides an improved material which may be used in a variety of arts and crafts applications. The present invention further seeks to provide an easily manufactured arts and crafts material which may be made in an economical manner. This new material is sufficiently durable for use in a variety of environments while satisfying the need for a material which is easily cut and shaped to form a particular configuration.

Generally described, the present invention includes a sheet of material for use in arts and crafts. The arts and crafts material includes a sheet of thin flexible foil for enhancing the visual characteristics of the arts and crafts material. A thicker base material underlies the foil sheet. The foil sheet substantially uniformly adheres to the base material in a substantially uniform manner. Peeling back the sheet of foil from the base material results in the foil's coating being retained on the base material.

In accordance with one embodiment of the present invention, the arts and crafts material is unaltered by water and the base material is resiliently compressible.

In accordance with another embodiment of the present invention, portions of the arts and crafts material with the foil coating are used to manufacture portions of fishing flies.

The foregoing has outlined rather broadly, the more pertinent and important features of the present invention. The detailed description of the invention that follows is offered so that the present contribution to the art can be more fully appreciated. Additional features of the invention will be described hereinafter. These form the subject of the claims of the invention. It should be appreciated by those skilled in the art that the conception and the disclosed specific embodiment may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

Similar reference characters refer to similar parts throughout several views of the drawings.

DETAILED DESCRIPTION

Figure 1:
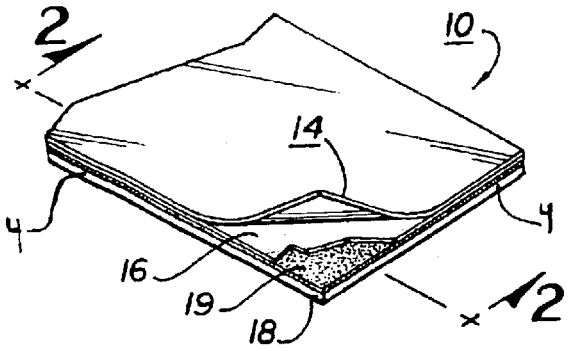
FIG. 1 is a perspective view of one embodiment of a sheet of arts and crafts material of the present invention.
Figure 2:
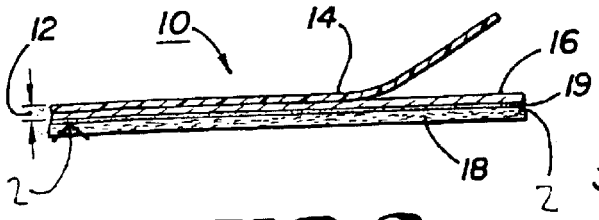
FIG. 2 is a cross-sectional view taken along line 2—2 in FIG. 1.
Figure 3:
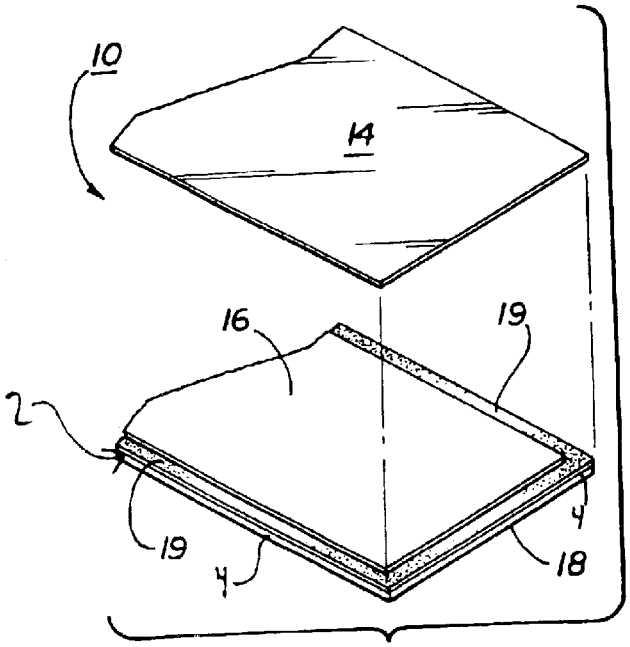
FIG. 3 is an exploded perspective view of the arts and crafts material of FIG. 1.

FIGS. 1–3 illustrate an exemplary embodiment of a sheet of arts and crafts material 10 of the present invention. Generally described, the sheet of material 10 includes a thin sheet of foil material 12, usually metallic and flexible. The foil 12 is commonly referred to as floppy rainbow foil and is preferably non-elastic. The foil 12 includes a disposable applicator 14 such as polyester film or other suitable means for serving as an applicator. A coating or film 16 comprising any metal or metallic compound is disposed upon the applicator 14. The foil 12 with applicator 14 and coating 16 may be purchased from Foilmark Manufacturing Corporation of Newbury Park, Calif., or from Jones Tones, Inc., of Pueblo, Colo.

The sheet of arts and crafts material 10 also includes a core or base material 18 to serve as a backing for the application of the foil 12. As shown in FIGS. 1–3, the base material 18 has a surface 2 bounded by a perimeter 4, and surface 2 defines an area bounded by the perimeter 4. The base material 18 is thicker and more rigid than the foil 12. Typically, the base material is approximately 2 mm thick. The base material 18 is preferably insoluble and should retain its structure when immersed in a liquid such as water. In other words, the base material 18 should not disintegrate in water like ordinary paper. The base material 18, however, is flexible. The base material 18 should be easily cut with scissors or by any cutting tool.

In one embodiment of the present invention, the base material 18 is a closed-cell foam. Although synthetic materials are preferred for the base material 18, natural materials such as leather may also be used for receiving the foil 12. In the preferred embodiment, the base material 18 is resiliently compressible. In such case, the resiliently compressible base material 18, will return to a particular shape by itself. Foam base material 18 is available from Darice, Inc. of Strongsville, Ohio.

As best shown in FIGS. 1–3, the foil 12 is secured to the base material 18 in substantially a uniform manner. One method for accomplishing uniform attachment of the foil 12 to the base material 18 is to use an adhesive 19 such as rubber cement. When using rubber cement, a curing period of approximately five to six minutes may be needed before securing the foil 12 and base material 18 together. The adhesive 19 is preferably a pressure sensitive adhesive. Alternatively, other types of adhesive may be used such as heat sensitive adhesives. In another alternative embodiment, foam having a sticky surface on one or both sides may be used. This type of foam is commonly referred to as sticky foam or self stick foam which is also available from Darice, Inc. of Strongsville, Ohio.

Once the sheet of foil 12 and the base material 18 are mated together, the applicator 14 is peeled from the base material 18. Peeling back the applicator 14 of the sheet of foil 12 from the base material 18 results in the foil's coating 16 being retained on the base material 18. The foil's pattern or coating 16 is maintained on the base material 18 even after extended use.

The manufacture of the arts and crafts material 10 of present invention constitutes an inventive method of the present invention in addition to the arts and crafts material 10 itself. In manufacturing the arts and crafts material 10, the first step is providing the base material 18. The inventive method then includes applying an adhesive 19 to a surface 2 of the base material 18. Next, the method includes substantially uniformly adhering a sheet of foil 12 to the surface 2 of the adhesive-coated base material 18. The sheet of foil 12 may then be pressed onto the base material 18 with the aid of a tool (not shown) such as a hand-held roller to form the sheet of arts and crafts material 10. The method then includes the step of peeling back the foil 12 from the base material 18 resulting in at least a portion of the foil's coating 16 being imprinted upon or transferred to the base material 18. The method may then further include the step of removing at least a portion of the sheet of material 10 so that the underlying base material 18 with the metallic coating may be used in an arts and craft project.

Figure 4:
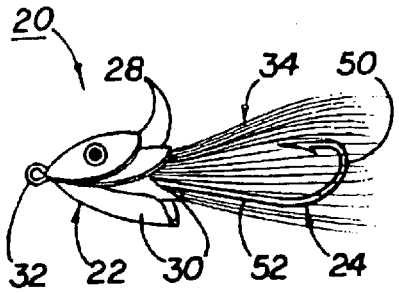
FIG. 4 illustrates one embodiment of a fishing lure of the present invention formed from portions of material shown in FIG. 1.
Figure 5:
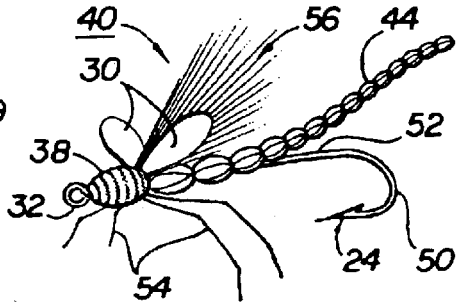
FIG. 5 illustrates an alternative embodiment of a fishing lure of the present invention also formed from portions of material shown in FIG. 1.

For example, fishing flies such as those shown in FIGS. 4 and 5 may be made with the use of the arts and crafts material 10. Using a bait that will tempt your quarry into taking the hook is one of the secrets of angling success. The prepared arts and crafts material 10 may be used for enhancing the visual characteristics of the fishing fly. There are numerous types of fishing flies such as, but not limited to, winged wet flies, winged dry flies, nymphs and streamers. However, all flies require realistic appearance in shape and color as well as action. Accordingly, the arts and crafts material 10 may be used to make portions of the flies in many different color patterns as well as shapes and sizes to suggest creatures such as insects.

In one embodiment, the present invention includes a kit of a plurality of sheets of arts and crafts material 10. The plurality of sheets of arts and craft material 10 should provide different color patterns for the user to chose from when making fishing flies or when working on other projects. When exposed to or immersed in liquids such as water, the material 10 maintains the visual appearance provided by the imprint provided by the foil 12 on the base material 18. The foil coating 16 on the outer surface of the portion of the base material 18 defining the body of the fishing fly provides a visually appealing target for a fish.

Figure 6:
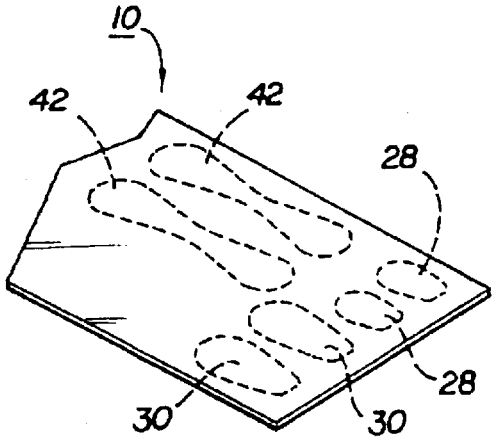
FIG. 6 is a perspective view of the arts and crafts material of FIG. 1 with broken lines shown thereon indicating various shapes which may be cut from the material.

Fishing fly 20 in FIG. 4 includes body 22 secured to a hook 24. The body 22 in this embodiment is made up of overlapping portions of the arts and crafts material 10. Referring now to FIGS. 4 and 6, the body 22 has two portions 28 which partially overlap one another and two larger portions 30 which also partially overlap one another. FIG. 6 best illustrates with broken lines the portions 28 and 30 which may be removed by cutting out portions of the arts and crafts material 10 with scissors (not shown) or by other known means such as stamping. Preferably, the portions 28 and 30 are secured immediately behind the eye 32 of the hook 24 with an adhesive or with tying thread. The fishing fly 20 may also include a feathered tail 34 as shown in FIG. 4. Although a single hook 24 is shown, other types of hooks may also be used such as double or triple hooks.

Figure 7:
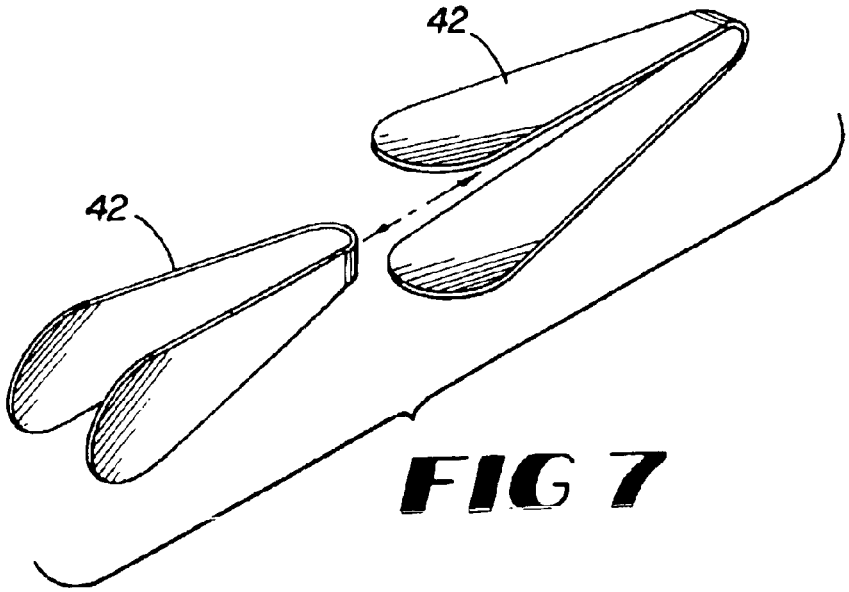
FIGS. 7 and 8 illustrate perspective views of two elongated portions of material after having been cut from the sheet of arts and crafts material which are arranged to form a portion of a fishing lure of the present invention.
Figure 8:
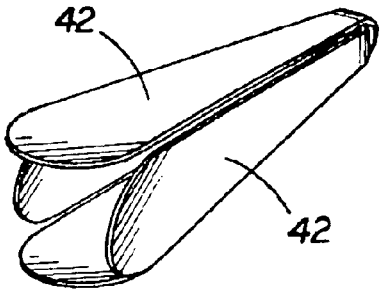

FIG. 5 illustrates a fishing fly 40 of the present invention manufactured from portions 30, described above, as well as portions 42 of arts and crafts material 10. As best shown in FIGS. 7 and 8, portions 42 are folded at their midsections and interlocked with one another to form an elongated tail-like portion or body 44. Tying thread 36 may then be used along the length of the body 44 to provide the appearance that the body 44 is segmented.

Figure 9:
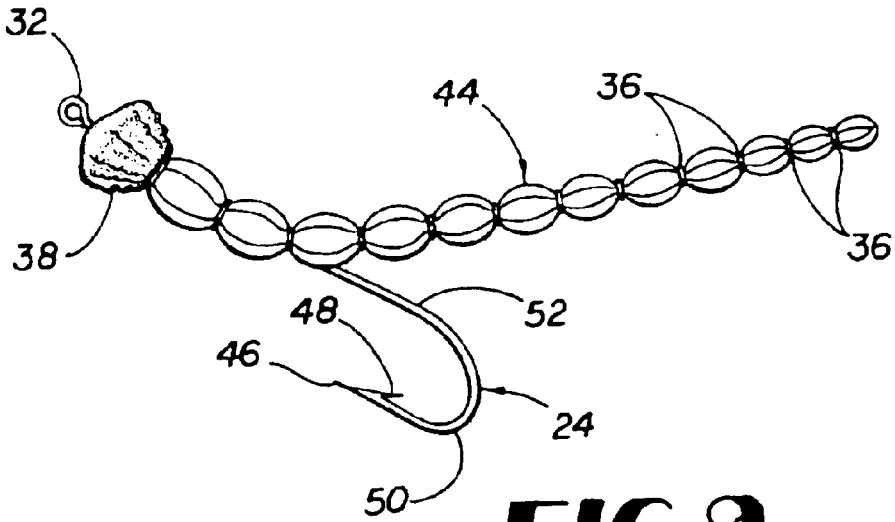
FIG. 9 illustrates a partially assembled fishing lure of the present invention formed from the portions of material shown in FIGS. 7 and 8.

FIG. 9 illustrates the body 44 of fishing fly 40 secured on the hook 24. To secure the tail 44 on the hook 24, the point 46 and barb 48 are passed through the first few segmented portions of the body 44 as best shown in FIG. 9. After the point 46 and barb 48 of the hook 24 pass through a few of the segmented portions of the body 44, these segmented portions of the body 44 are passed over the bend 50 and onto the shank 52 of the hook 24.

FIG. 5 also illustrates a head 38 of the fishing fly 40, a plurality of simulated legs 54 and a wing 56. The various elements of the flies 20 and 40 may be secured to their respective hook 24 with tying thread, adhesive or by other means known in the art.

From the foregoing description, it will be appreciated that the present invention provides an arts and crafts material which may used in a variety of projects as well as gifts and novelties. The present invention has been described in relation to particular embodiments which are intended in all respects to be illustrative rather than restrictive. Alternative embodiments will become apparent to those skilled in the art to which the present invention pertains without departing from its spirit and scope. Accordingly, the scope of the present invention is described by the appended claims and supported by the foregoing description.

What is claimed is:

1. A method of manufacture comprising:

providing a sheet of base material having a surface bounded by a perimeter, wherein said surface defines an area bounded by said perimeter;

applying an adhesive to said area of said sheet of base material;

applying a sheet of foil comprising an applicator and a coating to said area such that the entirety of said surface bounded by said perimeter is covered by said coating;

peeling said applicator from said base material sheet;

in response to said peeling step, retaining the coating of said foil sheet on said base material sheet;

cutting through said base material to form a predetermined shaped portion of base material and coating;

removing said predetermined shaped portion of base material and coating from said sheet of base material; and securing said predetermined shaped portion of base material and coating to a fishing hook.

2. The method of claim 1, wherein said predetermined shaped portion of base material and coating and said fishing hook define a fishing device.

3. The method of claim 2 further comprising exposing said fishing device to water and maintaining the visual appearance of said fishing device following said exposure to water.

4. The method of claim 3 wherein exposing said fishing device to water comprises immersing said fishing device in water.

5. The method of claim 1, wherein said cutting of said base material occurs after applying said sheet of foil comprising an applicator and said coating to said surface of said base material.

6. A method of making a fishing fly comprising:

constructing a sheet of arts and crafts material wherein the sheet of arts and crafts material comprises a foil sheet adhered to a base material, the foil sheet comprising an applicator and a coating, wherein the base material has a surface bounded by a perimeter and the coating substantially covers all of the surface of the base material bounded by the perimeter;

peeling the applicator from the foil sheet so that the base material retains the coating of the foil sheet;

cutting through the base material to form a predetermined shaped portion, said portion including the base material and the coating;

removing the predetermined shaped portion from the sheet of arts and crafts material, wherein the portion includes the base material and the coating; and securing said removed portion to a fishing hook.

7. The method of claim 6, further comprising securing said removed portion to the fishing hook with an adhesive or tying thread.

8. The method of claim 6, further comprising removing a second predetermined shaped portion, the second predetermined shaped portion including the base material and the coating, and securing said second removed portion to the fishing hook.

9. The method of claim 6, further comprising folding said removed portion to form an elongated tail portion.

10. The method of claim 6, further comprising segmenting said removed portion in a plurality of segments by tying the removed portion with tying thread.

11. The method of claim 6, wherein said coating is a metallic coating.

12. The method of claim 6, wherein said applicator is a polyester film applicator.

13. The method of claim 6, wherein said cutting of said base material occurs after adhering said sheet of foil comprising an applicator and said coating to said surface of said base material.

14. A method of making a fishing fly device comprising:

providing a sheet of base material having a top outer surface, said base material readily cuttable with a cutting tool;

applying an adhesive to substantially all of said top outer surface of said sheet of base material;

applying a foil sheet to substantially all of said top outer surface and said adhesive, said foil sheet comprising an applicator and a coating to form a sheet of arts and crafts material;

removing said applicator from said base material so that said base material retains said coating on substantially all of said outer surface;

cutting through said base material and said coating of said arts and crafts material to form a predetermined shaped portion of said base material and said coating;

removing said cut predetermined portion comprising said base material and said coating from said sheet of base material; and securing said removed portion to a fishing hook.

15. The method of claim 14, further comprising constructing said arts and crafts material with a water insoluble base material.

16. The method of claim 14, further comprising pressing said foil onto said base material with a pressing tool.

17. The method of claim 14, further comprising placing a metallic patterned coating on said applicator to form said foil sheet.

18. The method of claim 14, further comprising adhering said foil sheet to said base material with an adhesive selected from the group consisting of rubber cement, sticky foam, self stick foam, and a heat sensitive glue.

19. The method of claim 14, wherein said cutting of said base material occurs after applying said sheet of foil comprising an applicator and said coating to said surface of said base material.

* * * * *